US005638415A

United States Patent [19]

Nafziger et al.

[11] Patent Number: 5,638,415

[45] Date of Patent: Jun. 10, 1997

[54] MULTIPLE PORT PROBE DELIVERY SYSTEM

[76] Inventors: Mark W. Nafziger, R.R. #2, Baden, Ontario, Canada, N0B 1G0; Richard I. Nafziger, 124 William Street South, Wellesley, Ontario, Canada, N0B 2T0

[21] Appl. No.: 668,750

[22] Filed: Jun. 24, 1996

[51] Int. Cl.[6] ..... G21C 17/00

[52] U.S. Cl. ..... 376/260; 165/11.2; 73/866.5

[58] Field of Search ..... 376/245, 249, 376/260, 316; 165/11.2, 11.1; 73/866.5

[56] References Cited

U.S. PATENT DOCUMENTS

| | | | |
|---|---|---|---|
| H1115 | 12/1992 | Nachbar | 165/11.2 |
| 4,407,236 | 10/1983 | Schukei et al. | 165/95 |
| 4,424,769 | 1/1984 | Charamathieu et al. | 376/310 |
| 4,638,667 | 1/1987 | Zimmer et al. | 376/260 |
| 4,980,120 | 12/1990 | Bowman et al. | 376/316 |
| 5,065,703 | 11/1991 | Lee | 73/866.5 |
| 5,341,406 | 8/1994 | Jens et al. | 376/316 |
| 5,411,043 | 5/1995 | Kamler | 122/392 |

*Primary Examiner*—Daniel D. Wasil
*Attorney, Agent, or Firm*—R. Craig Armstrong

[57] ABSTRACT

A probe delivery system for delivering a bendable probe into a tube bundle is provided. The system uses an elongated guide which is insertable into the tube bundle via the access opening. The guide has a channel for directing the probe therealong and several pivotable port devices spaced along the length of the guide, operable to selectively direct the probe either farther along the guide, or outwardly and away from the guide and into the tube bundle. Actuators operate the port devices, and may be pneumatic, for example. A base is mountable on the shell which surrounds the tube bundle, and a servomotor is mounted on the base to move the guide in and out of the tube bundle. A rotation drive servomotor preferably is mounted on the base for rotating the guide about its central axis. Preferably, the system includes a spool drive for the probe itself, having a rotatable substantially circular spool around which the probe may be wound for feeding into and retracting from the tube bundle.

11 Claims, 13 Drawing Sheets

MULTIPLE PORT PROBE DELIVERY SYSTEM

BACKGROUND OF THE INVENTION

This invention relates, in general, to equipment for performing maintenance operations on steam generators, and in particular, to a multiple port apparatus for delivering a probe into the tube bundle of a steam generator. The invention was conceived particularly with a view towards nuclear-powered steam generators, and many references herein are to that particular application, but it should be clearly understood that the invention is applicable to a wide variety of steam generators and heat exchangers generally, not just those which are nuclear-powered.

A steam generator typically comprises a vertically oriented vessel, a plurality of U-shaped tubes disposed in the vessel so as to form a U-shaped tube bundle, and a tube sheet for supporting the tubes at the ends opposite the U-shaped curvature. The tubes are tightly spaced and arranged in a matrix configuration, forming intertube lanes which are often less than 0.5 inches in width. A central internal division, known as a no-tube lane, is formed between hot and cold legs of the tube bundle. In a nuclear-powered steam generator, for example, the primary fluid used, generally heavy water, is heated by the core of a nuclear reactor as the fluid passes through the tube bundle, and secondary fluid, usually regular water, is fed into the spacing surrounding the tubes. The heat transfer from the hot tubes to the regular water creates steam. The constant high temperature and severe operating conditions result in the formation of deposits and accumulation of sludge on the tubes, tubesheet, and other internal components of the steam generator. These can cause blockages of the internal spacing which results in oscillation of the steam generator, and corrosion of the tubes. This results in decreased efficiency of the heat transfer, and in the case of nuclear-powered steam generators, can result in leakage of heavy water into the regular water. Steam generators thus require regular internal inspection to assess their condition, and cleaning to remove the harmful sludge and deposits.

Existing procedures for maintaining a steam generator generally involve probes which perform a variety of operations inside the tube bundle, including waterlancing, inspection, sampling and retrieval. The probes are designed to be slender to perform within the restrictions of the intertube lane dimensions, and are directed into the tube bundle by a delivery system, which enters the steam generator through openings in the shell of the steam generator. Such openings generally are access holes which are threaded to enable sealing for operation, and are thus appropriate for attaching probe delivery equipment. Inside the steam generator, the delivery system occupies the no-tube lane or the annulus for accessing the tube bundle, and utilizes a device for directing the probe into the desired location in the bundle.

U.S. Pat. No. 4,407,236, entitled "Sludge lance for nuclear steam generators", describes guide diverter structure portions for delivering a lance into the tube bundle of a steam generator. U.S. Pat. No. 4,424,769, entitled "Process and apparatus for removal of the sludge deposits on the tubesheet of a steam generator", describes a drive for feeding a lance into or out of a steam generator tube bundle directly through an access hole. U.S. Pat. No. 4,638,667, entitled "Remote probe positioning apparatus", describes a telescopic boom and a tractor feed and deflector block apparatus for delivering a probe into the tube bundle of a steam generator. U.S. Pat. No. 4,980,120 entitled "Articulated sludge lance", describes a guide and an articulated mechanism for delivering a lance into the tube bundle of a steam generator. U.S. Pat. No. 5,065,703 entitled "Flexible lance for steam generator secondary side sludge removal", describes a transport apparatus for delivering a lance into the tube bundle of a steam generator. U.S. Pat. No. 5,341,406 entitled "Sludge lance guide flexible lance system", describes a support rail, a rigid guide, and a lance guide nose apparatus for delivering a lance into the tube bundle of a steam generator. U.S. Pat. No. 5,411,043 entitled "Articulated annular sludge lance", describes track members, a manipulator head, a delivery rail, and a flexible manipulator for delivering a lance into the tube bundle of a steam generator.

The existing systems suffer from the disadvantages of being difficult to operate in confined spaces, and particularly in steam generators with restricted access. As a result the systems lack optimum precision for locating and directing the probe, and lack optimum protection of the probe during operation. There is thus a need for a probe delivery system which lends itself to operation in confined spaces for improved precision of location and directional control of the probe, and also having suitable protection for the probe during operation.

SUMMARY OF THE INVENTION

In the invention, an improved probe delivering system is obtained by incorporating several ports along the length of a guide for directing the probe. The guide is inserted into the tube bundle, and the probe is routed along the guide. Each port is configured such that when it is in an open position the probe is directed laterally away from the guide, for entry into the tube bundle of a steam generator, and when it is in a closed position the probe is directed farther along the guide towards more distant ports.

With this configuration, the guide needs only advance a distance equal to the spacing between adjacent ports in order to allow each port to access a unique range of intertube lanes. Access to any particular intertube lane may be achieved by placing the appropriate ports in the closed and open positions, and advancing the guide such that the exit of the open port aligns with the intertube lane.

This guide configuration improves upon prior art methods because the guide undergoes considerably less motion during operation. This allows the design and operation of the apparatus to be improved upon in several ways:

1) Significantly less interference with obstructions in the work space are realized with the operational motions of the apparatus, and special designs and methods for dealing with interference become unnecessary.
2) The design of the guide advancing mechanism can be highly simplified because of the small required motion, resulting in cost savings and compact design for improved access.
3) The guide may be optimized for strength and stiffness because it lends itself to a single piece construction.
4) Minimum sliding parts are incorporated into the design, thus improving reliability of the apparatus when it is required to operate in a tight and often gritty environment.

BRIEF DESCRIPTION OF THE DRAWINGS

The invention will now be described in detail, with reference to the accompanying drawings, in which.

DETAILED DESCRIPTION OF THE PREFERRED EMBODIMENTS

Introduction

Figure 2:
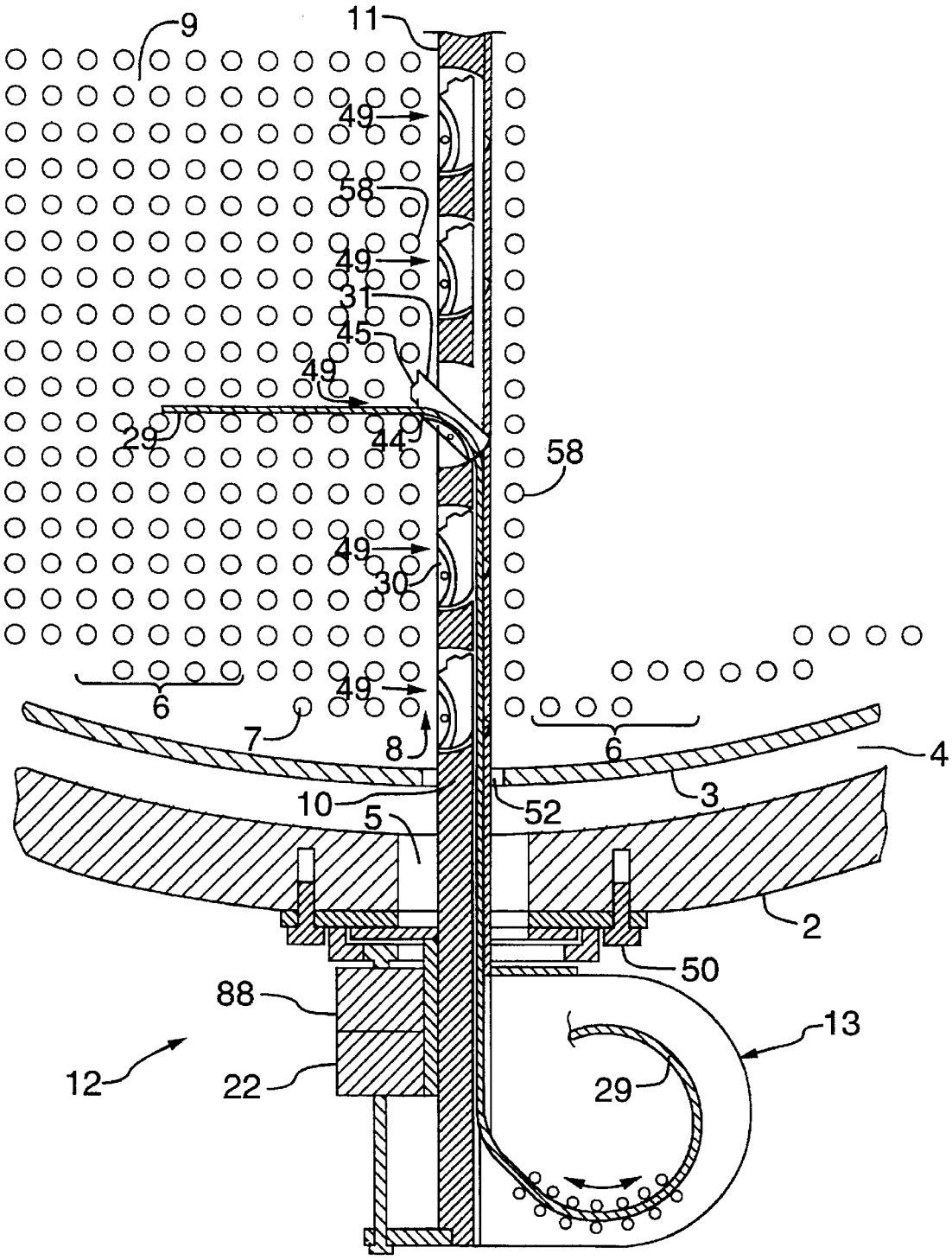
FIG. 2 is a top sectional view of the steam generator of FIG. 1 along the lines X—X, including a top sectional view of a preferred embodiment of the invention.
Figure 3:
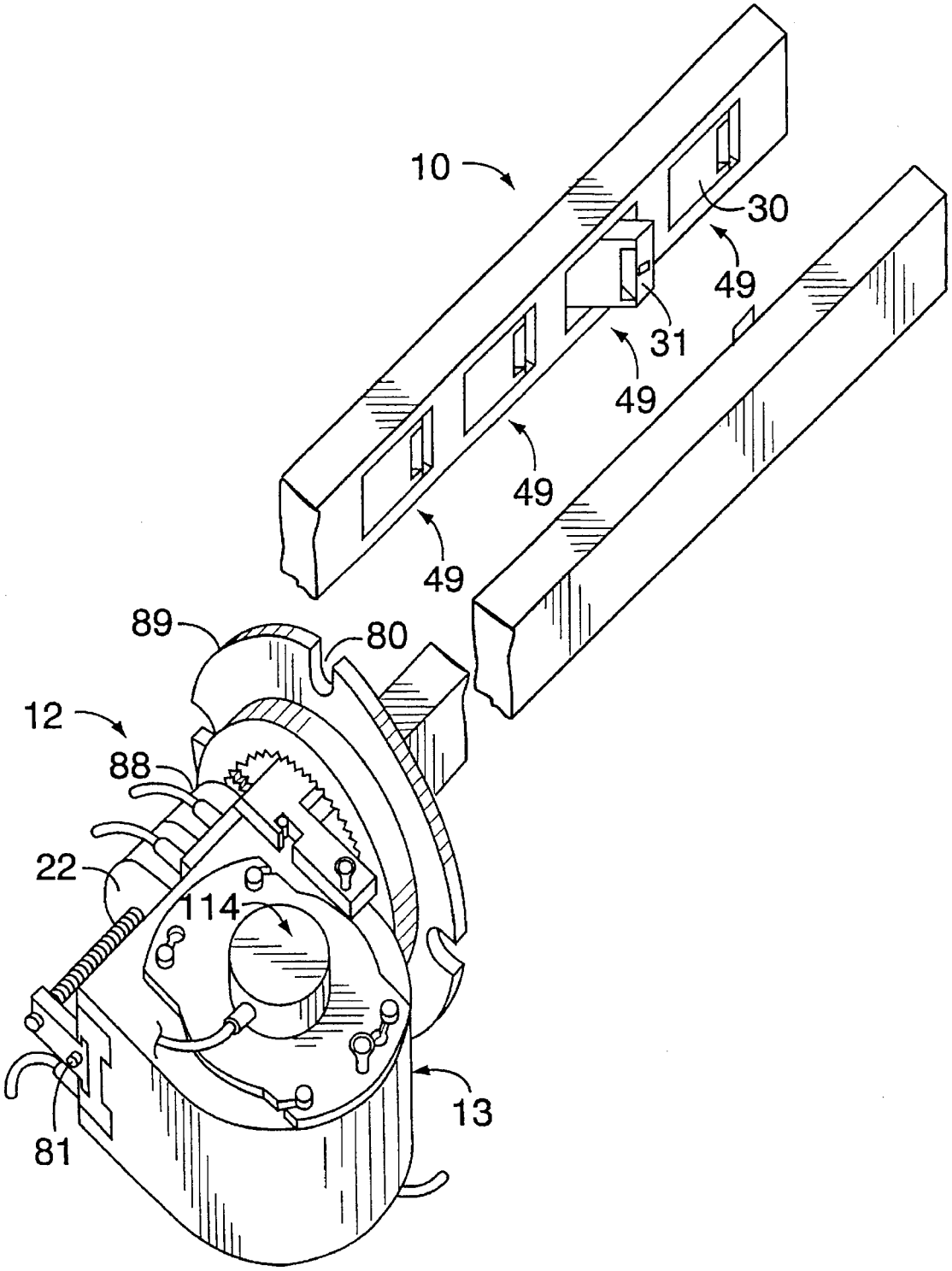
FIG. 3 is an isometric view of a preferred embodiment of the invention.
Figure 13:
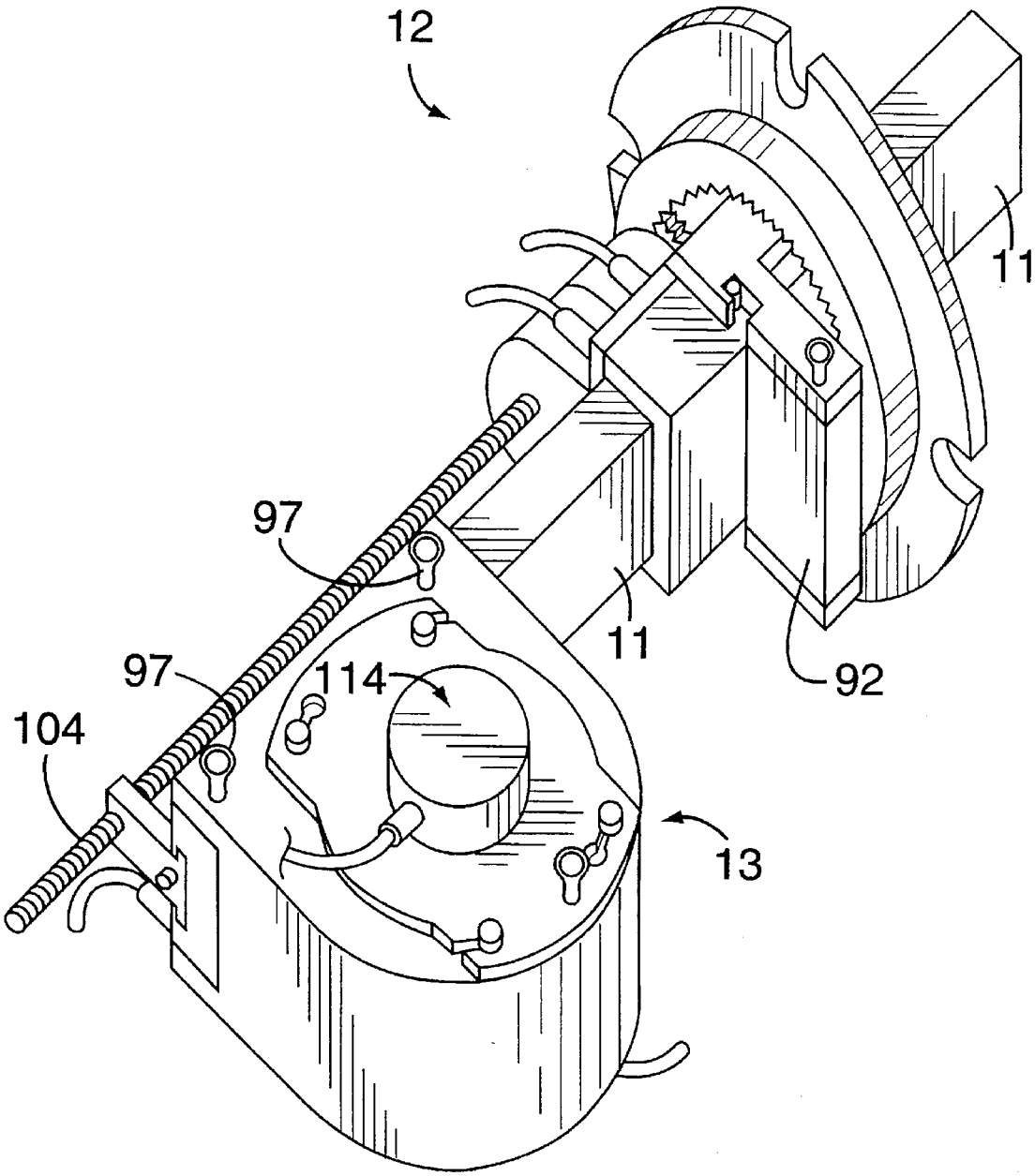
FIG. 13 is an isometric view of an alternate configuration for mounting the probe drive.
Figure 14:
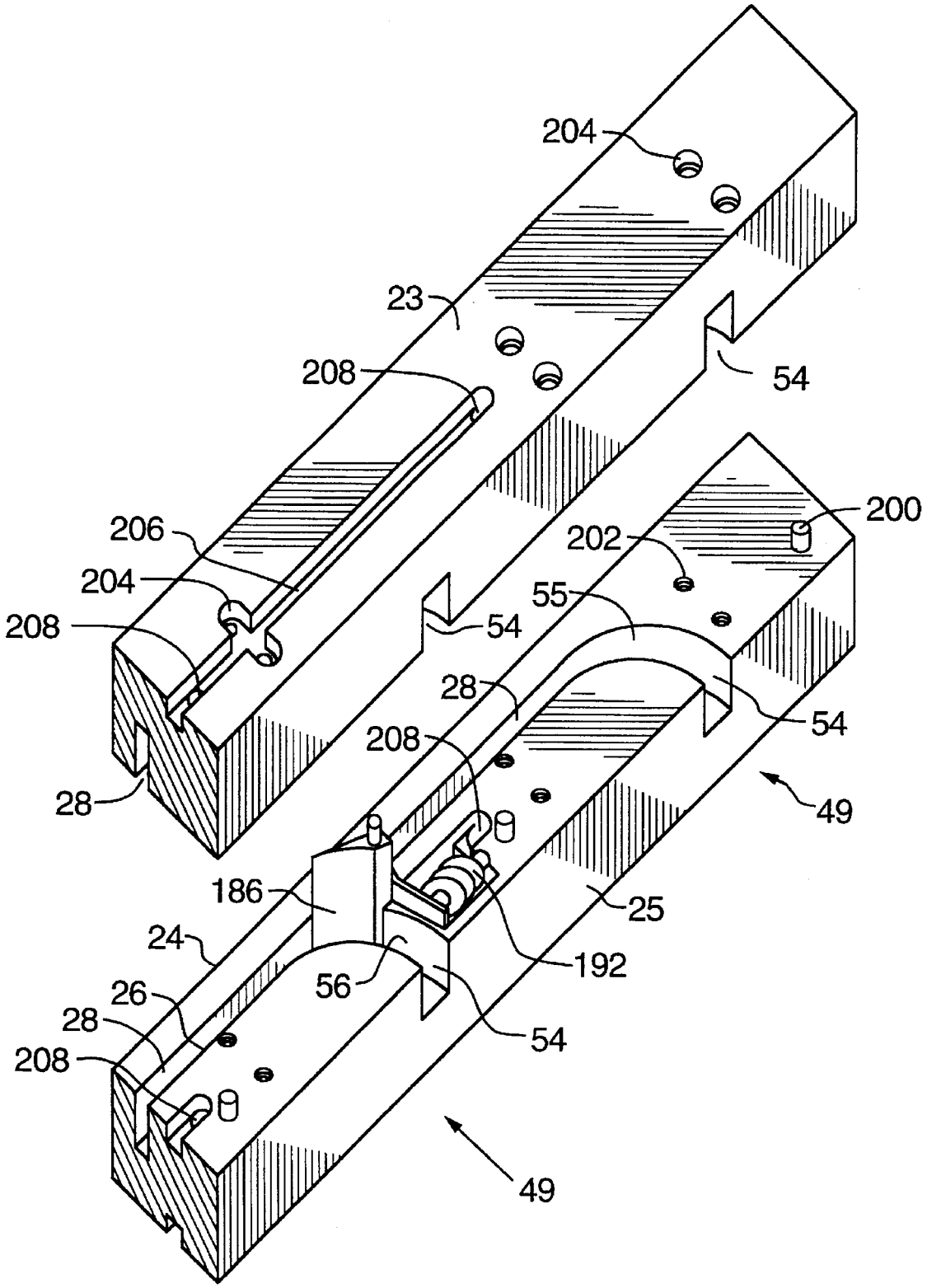
FIG. 14 is an isometric view of an alternate design for the port means.

Preferred embodiments of the invention are shown in FIGS. 2 to 12, which include a guide 10 (FIGS. 2–6), a base 12 (FIGS. 2, 3, and 12), a friction probe drive 13 (FIGS. 2, 3, and 6–10 and a probe drive servomotor 114 (FIGS. 3 and 11). FIGS. 13 and 14 show alternate embodiments of the invention. A probe 29 has been included in the description to show how it functions with the invention, but is not itself part of the invention.

Figure 1:
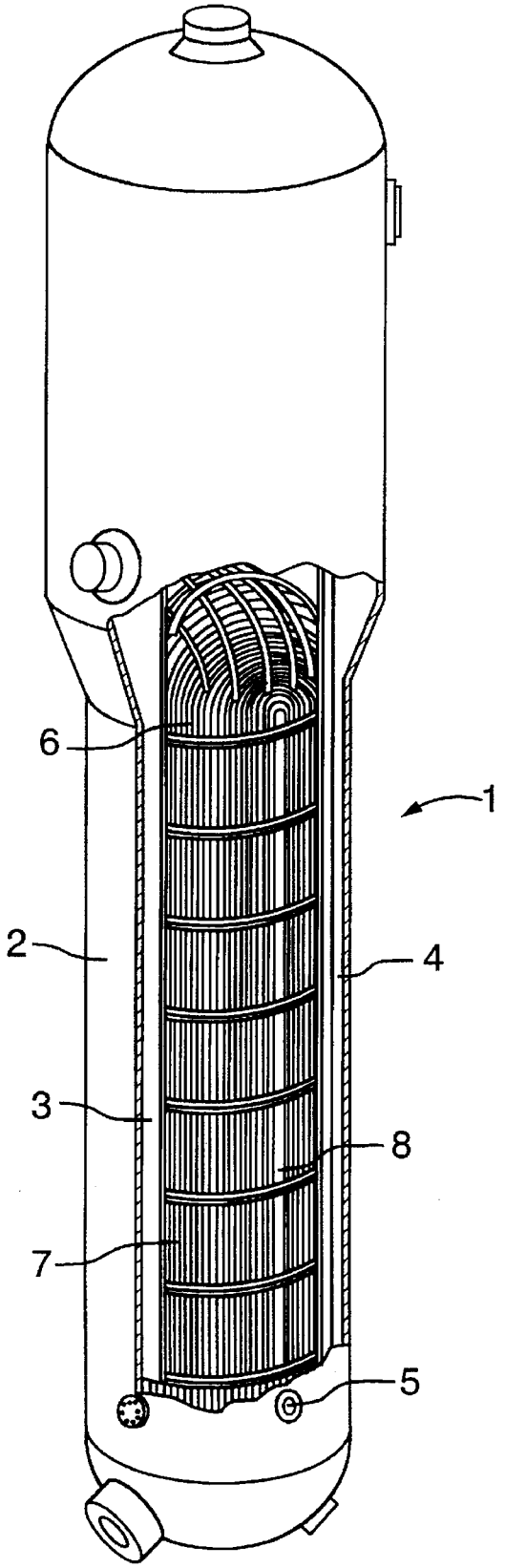
FIG. 1 is a partially cut away isometric view of a steam generator.

Referring first to FIG. 1, a typical steam generator 1 contains a tube bundle 6 comprising a plurality of U-shaped tubes 7, supported at the base by a tubesheet (not shown). A central internal division between two legs of the bundles 6 forms a no-tube lane 8. The tubes carry the primary fluid, heavy water for example (in the case of a nuclear-powered steam generator), for heating the secondary fluid, regular water for example, which flows in the spaces 9 (FIG. 2) between the tubes 7. During maintenance outage of the steam generator, the regular water is drained, and work operations can be performed within the spaces 9 by means of equipment which can be delivered into the no-tube lane 8 through openings at appropriate locations in the outer shell of the steam generator, such as threaded opening 5.

Referring now to FIG. 2, the tubes 7 are arranged in a matrix configuration, with the no-tube lane 8 between the two legs of the tube bundles 6. The tubes are contained within an inner shell 3, and an outer shell 2 which define an annulus 4 around the inner shell. A guide 10 comprising an elongated body 11 is inserted into the no-tube lane 8 through the access opening 5 and inner shell opening 52.

Referring now to FIGS. 2 and 3, a base 12 mounts to the access opening 5. The base incorporates a rotation drive servomotor 88 for rotating the guide about its central axis, and a guide drive servomotor 22 for displacing the guide 10 along the no-tube lane 8. A friction probe drive 13 is mounted to the base 12 and performs extension and retraction operations of a probe 29 in the guide 10. The probe may be driven by any suitable means.

The guide 10 incorporates several ports 49 which are positioned at equal spacing and are used for directing the probe. Each port is configured so that when it is closed, as indicated by a closed shoe 30, the probe is directed along the guide, and when it is opened, as indicated by an open shoe 31, the probe is directed away from the guide and into the tube bundle.

The Guide

Figure 4:
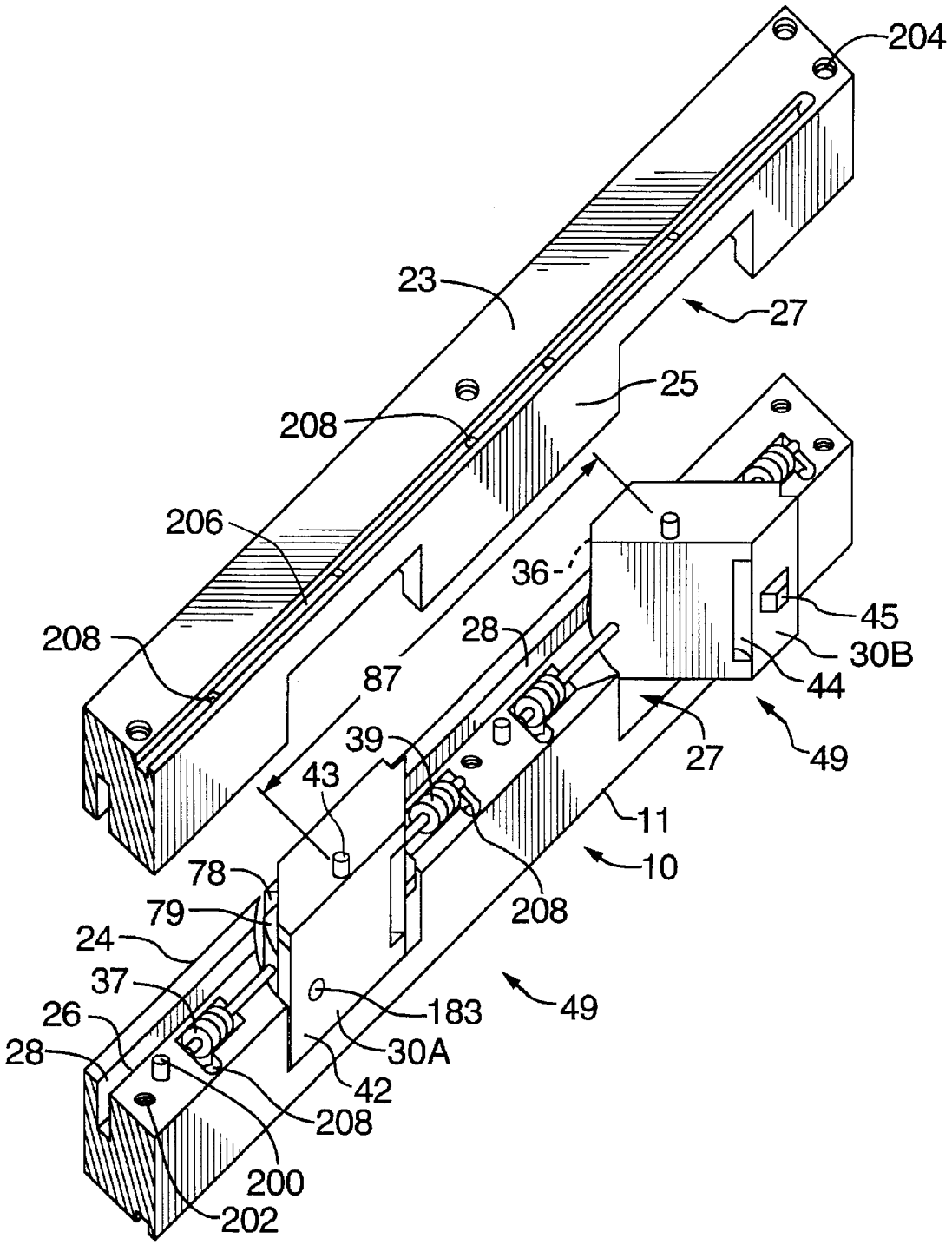
FIG. 4 is a partly exploded view of the guide shown in FIG. 3.
Figures 5A, 5B:
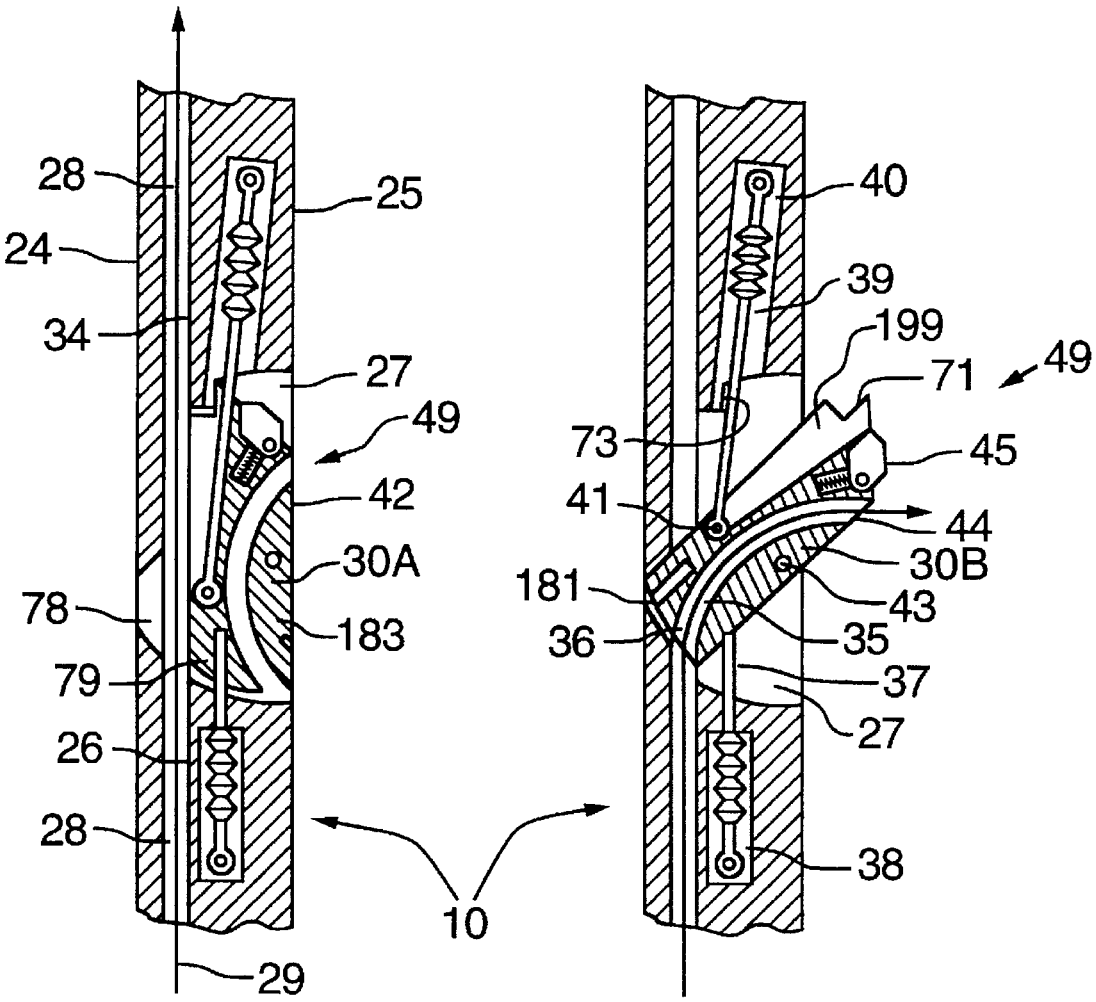
FIGS. 5A and 5B are top sectional views of the part means of the guide shown in FIG. 3 in a resting and an engagement positions respectively.

Referring now to FIGS. 4 and 5, the elongated body 11 of the guide 10 is constructed from left and right hand casings 23, and incorporates a closed shoe 30A, and an open shoe 30B at the port locations. A split casing 23 was chosen for the design because it lends itself well to incorporation of components in the guide. The shoes pivot for obtaining the open and closed positions of the shoe. This design was chosen for directing the probe because it allows the guide to be slender when the shoes are in the closed position, which has an advantage in cases where access into a steam generator is restricted, such as a small diameter access opening.

An inner channel 28 in the elongated body 11 provides guidance for the probe to and from the shoe, and apertures 27 provide sufficient space to allow the shoes to pivot from closed to open. A first pin 43 engages in a hole (not shown) in the casings 23, allowing the shoe to pivot freely. The shoes are constructed with an aperture 36, an arcuate channel 35, and an exit 44 through which the probe is directed when a shoe is opened. A side wall 34 of the shoe is coplanar with the surface 26 of the inner channel 28 when the shoe is closed, so that continuous support is provided to the probe when it passes through the port location along the guide. A shoe lobe 79 forms part of the side wall 34, and fits in a notch 78 in the casings 23 to form a hard stop position when the shoe is opened, and a notch 71 and casing notch 73 form a hard stop position when the shoe is closed.

A first pneumatic actuator 38 and a second pneumatic actuator 39 provide locking and pivoting actions to the shoe respectively, and are mounted in casings 23 at a first cavity 38 and a second cavity 40 respectively. The first actuator is driven in or out of a first hole 181 on the shoe for locking and unlocking functions when it is in the closed position, and can be driven in or out of a second hole 183 on the shoe for locking and unlocking functions when it is in the open position. The locked positions are important to assure that the shoe does not pivot under the influence of the probe, as might be the case when the probe undergoes a significant loading. The second actuator attaches to the shoe at a second pin 41, so that when the actuator is extended, the shoe is forced to the closed position, and when it is retracted, the shoe is forced to the open position.

Small diameter pneumatic lines (not shown) are used to control the actuators. These are fed along an external slot 206 which extends the length of the guide, and through casing holes 208 which feed the actuators. Single acting actuators are most suitable for the operation of the shoe because they are relatively free to pivot (thus requiring little force to return), thus requiring only one line per actuator. The lines in the external slot 206 may be potted with a suitable adhesive or cast material so that they are secured to the casing. In the optimum configuration the actuators used for the pivoting function are connected to one pneumatic line, and the actuators used for the locking function are connected to individual pneumatic lines in order to minimize the number of lines. With this configuration, a shoe may be selected by unlocking it.

Alignment pins 200, threads 202, countersinks 204, and assembly bolts (not shown) are uses for fastening the halves of the casing together.

The Telescopic Feature at the Back End of the Guide

Figure 6A:
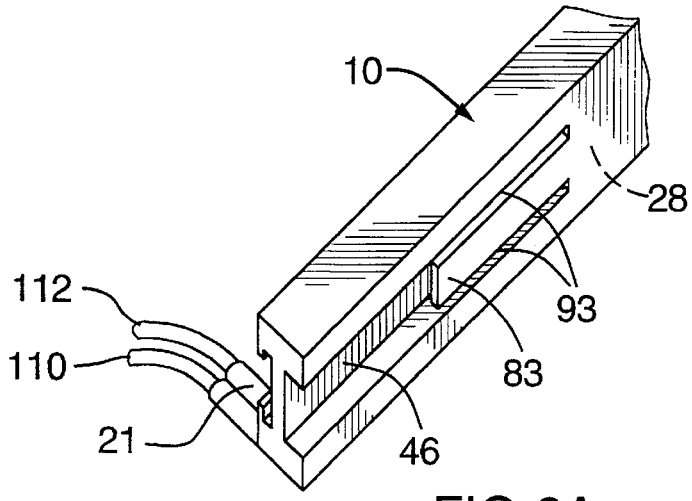
FIGS. 6A, 6B, and 6C are isometric views of an end of the guide showing the location for engagement with a probe drive.
Figure 6B:
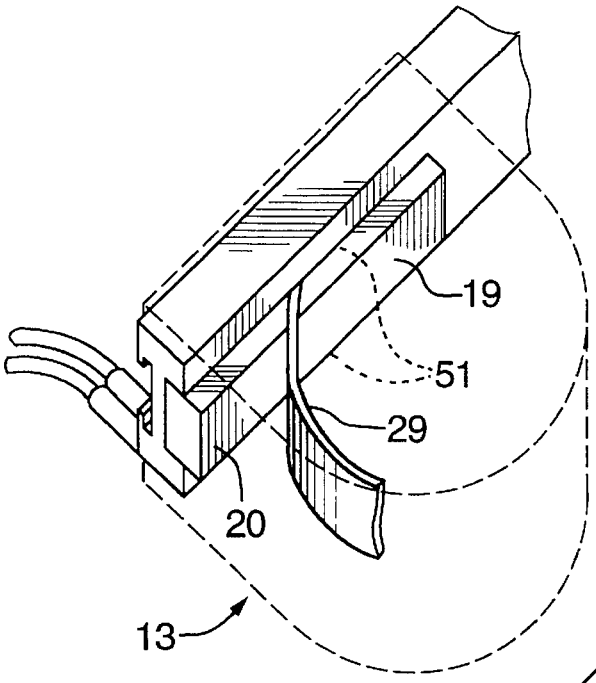
Figure 6C:
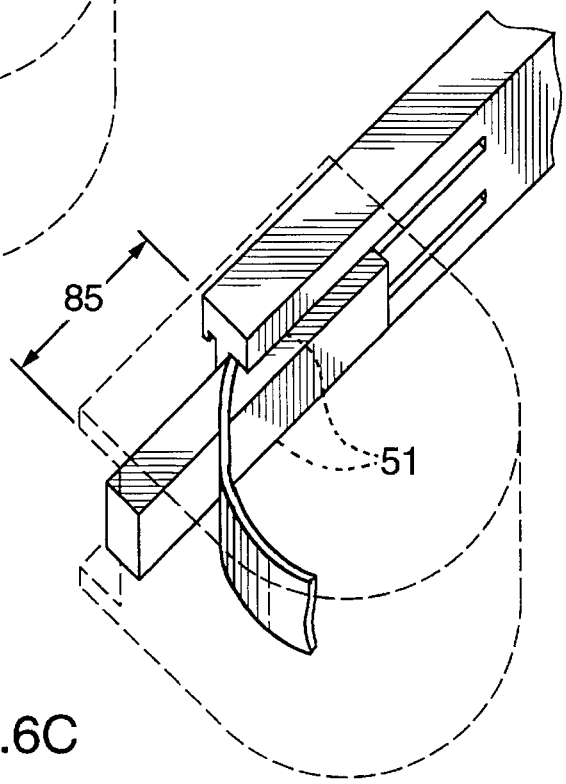

FIGS. 6A, 6B, and 6C show a telescopic feature incorporated at the back end of the guide and friction probe drive to provide continuous support to the probe 29 throughout the advance positions of the guide. This feature is necessary because an opening is naturally formed between the guide and friction probe drive when the guide is extended, which is unacceptable because the probe could buckle out of the space when it experiences sufficient compressive loading.

Referring to FIG. 6A, the back end of the guide includes an access area 46, a tongue 83 and through grooves 93 which facilitate the telescopic action. These features have been sized to allow the probe to enter anywhere along the access area 46, and to be captured behind the tongue 83 to provide a linear support into the inner channel 28 of the guide 10.

Referring to FIG. 6B, the engagement of the friction probe drive 13 and the probe 29 is shown with the guide in the retracted position. The container 13 of the friction probe drive is represented in phantom, and a portion of the probe 29 is shown between a separating wedge 19 and a supporting wedge 20 of the friction probe drive. The probe leaves the friction probe drive at an exit aperture 18 (FIG. 8) and enters the access area 46just in front of the tongue 83. In this position the through grooves 93 are occupied by rails 51 which protrude from the backside of the separating wedge 19.

FIG. 6C shows the friction probe drive 13 and the probe 29 with the guide in the extended position. The guide has been extended to its maximum amount (optimally equal to the advance range 85 of the guide), and the probe enters the access area 46 at the back end of the guide. In this position the rails 51 provide support to the probe over the length of the access area to the tongue 83.

The Friction Probe Drive

FIGS. 7–10 show the preferred friction probe drive. The friction drive improves upon prior art methods in that no engagement apertures are require on the probe body (as is required with sprocket or belt sprocket methods). This is an improvement because it reduces stress on the probe and imposes fewer limiting factors on the probe construction.

A container 13 has an arcuate side wall 163, an upper surface 162, a lower surface 158, and defines a substantially cylindrical cavity 165. The container can be secured and attached to delivery equipment by any suitable means, such as pins 94, and holes 164, and by mounting means such as bearing 156 at the separating wedge 19 and supporting wedge 20 of the container and the upper surface 162 and the lower surface 125 of the container at the rectilinear side wall 160.

A probe 29 is coiled and placed inside an inner container 167. The inner container is composed of several features which serve several functions. A drum 169 provides an attachment means to secure the input end 17 of the probe, a connection means to connect an input line 124 to the input end of the probe, a minimum bend radius to which the probe may be coiled, and an opening for housing an axle 166. A wall 168, an inner surface 170, a cover 148, and the drum 169 provide an envelope in which the back end of the probe may be managed during operation of the friction probe drive (these surfaces define the management space).

The probe is fed through a series of wheels 180 which gently squeeze and bend the probe through a gradual curvature. Several wheels are utilized in the design to achieve sufficient friction for driving the probe, while not squeezing too much at any one location. The wheels are composed of a suitable material which offers compliance and friction to the probe, such as rubber. The wheels are arranged with a gradual curvature in order to make the container more compact. The wheels have suitable bearing means at their ends, such as axle 144 in the upper surface 162 and lower surface 158 which enable them to rotate in either direction. Half of the wheels are fitted with a sprocket 176 permitting them to be driven by the chain 174. The other half of the wheels are driven by gears 178 which feed off the first half. The chain is driven by a sprocket 172 which is driven by the axle 168. The axle is engaged at a central aperture 150 by any suitable drive, such as the probe drive servomotor 114 (FIG. 11). The probe drive servomotor 114 is secured and attached to the upper surface 162 by any suitable means such as studs 122, and fastening pin 97 (FIG. 11)

The probe is guided through a gradual curvature defined by the separating wedge 19 and the supporting wedge 20 which form the exit aperture 18, and align the probe for entry into the access area 46 (FIG. 6A).

Figure 8:
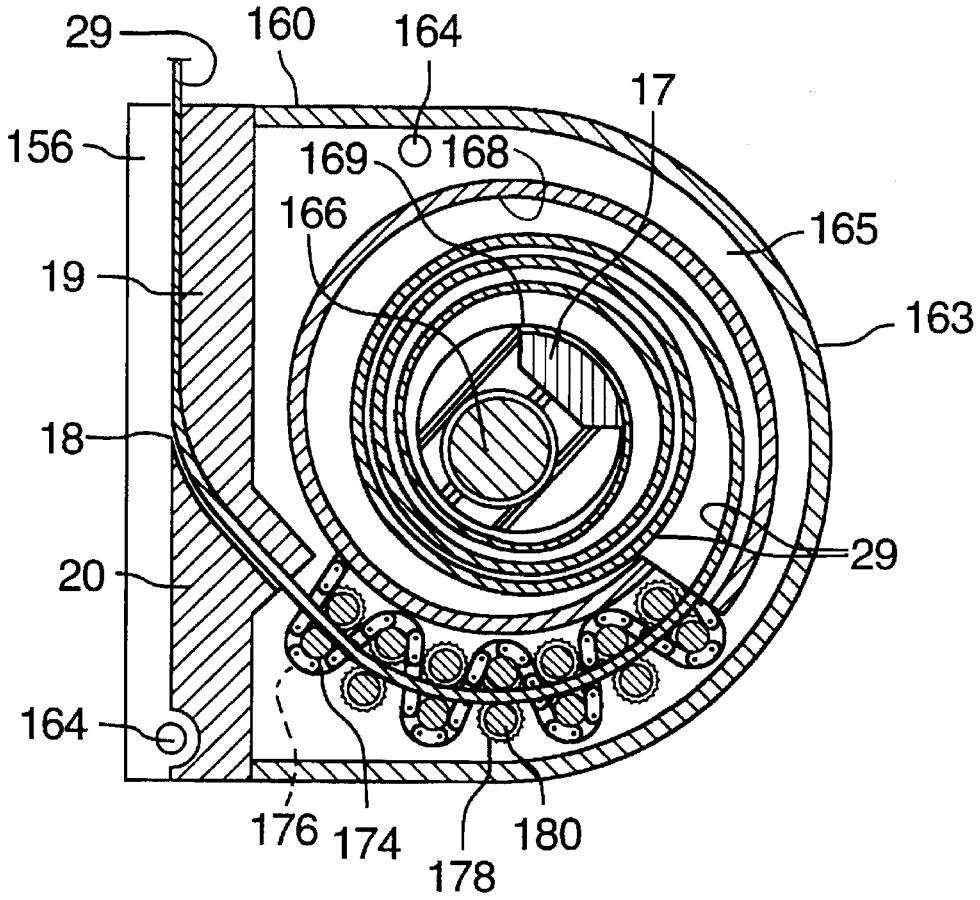
FIG. 8 is a sectional view of the embodiment of FIG. 7 along the lines X—X.
Figure 9:
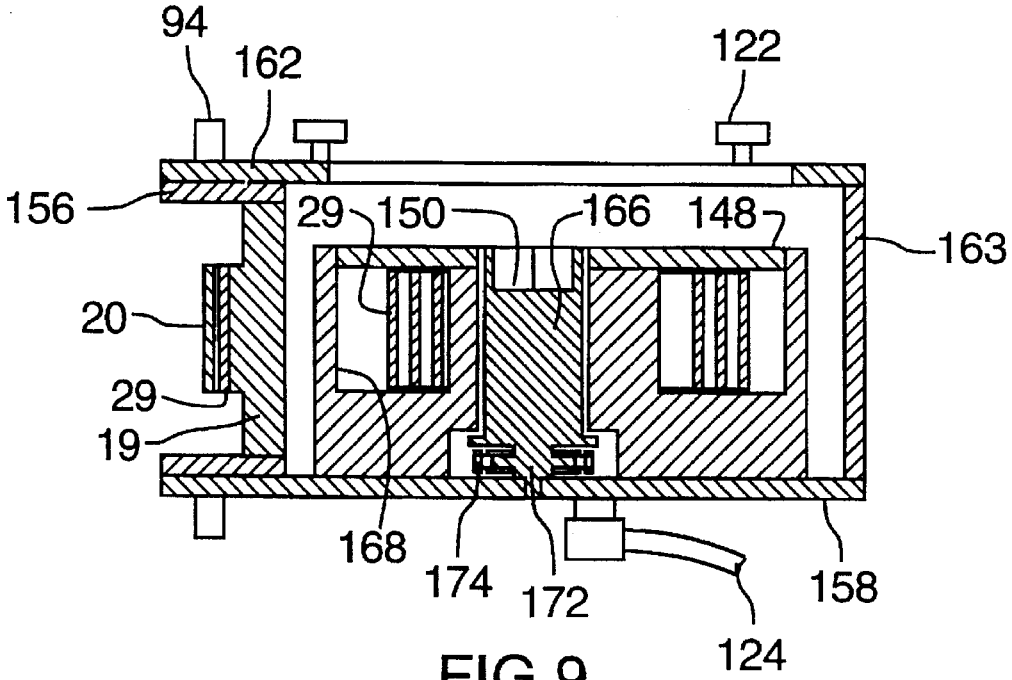
FIG. 9 is a sectional view of the embodiment of FIG. 7 along the lines Y—Y.

Referring to FIG. 8, with the above configuration, a counter clockwise rotation applied to the central aperture 150 will cause the axle 166 and chain 174 to move in a counter clockwise direction. This causes the outer wheels 180 to turn in a counter clockwise direction, and the inner wheels 180 to turn in a clockwise direction, enabling the probe to be driven from the management space through the wheels 180 and between the separating wedge 19 and supporting wedge 20 extending the probe from the exit aperture 18 of the container 13. The management space accommodates the extension of the probe by allowing the coils to shrink freely up to the point that they are wrapped tightly around the drum 169 (corresponding to the maximum extension).

Upon clockwise rotation of the central aperture by a suitable drive, the reverse of the above motions occur enabling the probe to be retracted into the container. In this operation, the coils at the back end of the probe are permitted to grow in the management space which are contained by the wall 168.

The friction drive mechanism and management space have been integrated into the container 13 to form a modular unit, but can be separated if need be. This may be the case if obstructions exist in close proximity to the access opening of the steam generator, in which case the friction drive mechanism can be constructed compact to negotiate the obstruction and the back end of the probe can be managed away from the obstruction.

The Probe Drive Servomotor

Figure 11A:
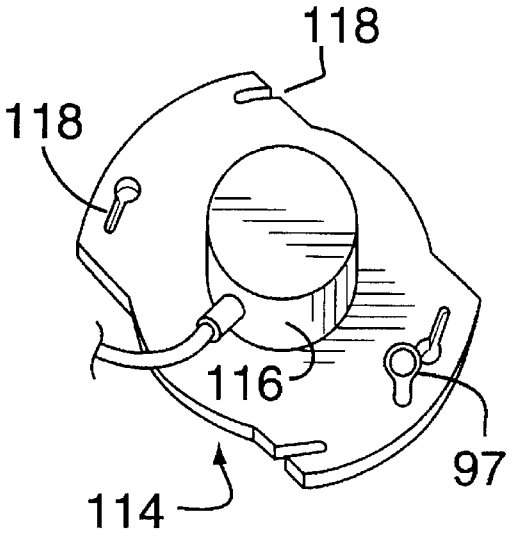
FIGS. 11A and 11B are isometric views of opposite sides of the preferred embodiment of the probe drive servomotor.
Figure 11B:
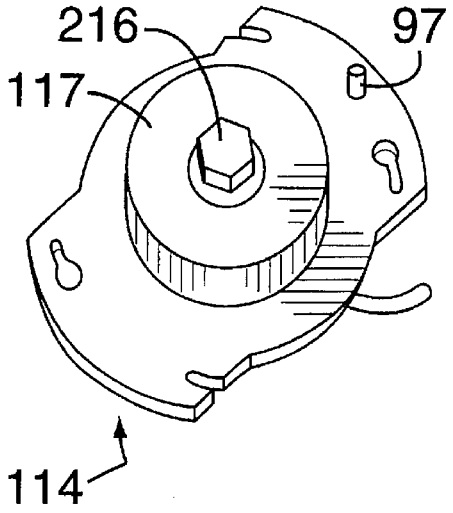

Referring now to FIGS. 11A and 11B, a probe drive servomotor 114 consists of a servomotor 116, a speed reducer 117, an output coupler 216, and slots 118. The assembly is attached to the friction probe drive 13 by retaining the servomotor bracket slots 118 with studs 122 on the friction probe drive, and securing with a fastening pin 97.

In operation, the coupler 216 engages the central aperture of the friction probe drive 13. The speed reduction is necessary to match the required speed and load characteristics of the probe and servomotor. Operation of the servomotor in the forward and reverse directions cause the friction probe drive to extend or retract the probe. Encoder counts from the servomotor allow the position of the probe to be monitored.

The Base

Figure 12:
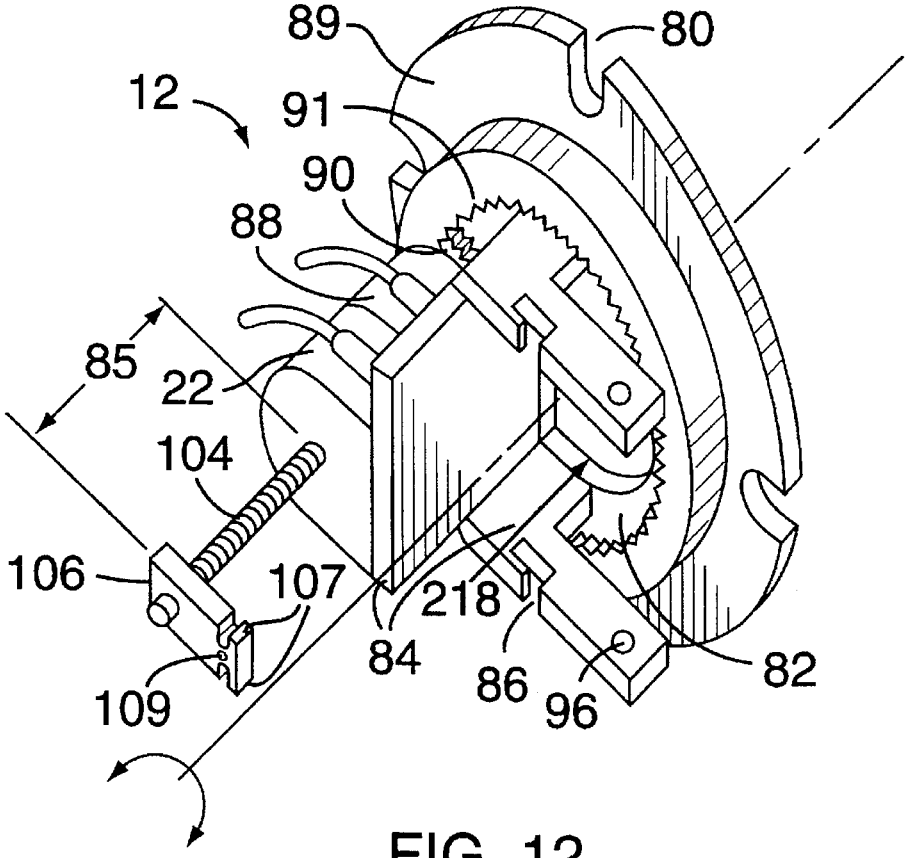
FIG. 12 is an isometric view of the preferred embodiment of the base.

FIG. 12 shows the base 12 which incorporates several features including a flange 89 for attaching to a steam generator access opening, a rotational drive, a guide drive, and a bracket for attaching the friction probe drive 13.

The base assembly is attached to a steam generator access opening by fastening flange 89 with bolts 50 (FIG. 2) at flange slots 80. Slots are preferred (over holes) because a bolt 50 may be installed on the access opening to facilitate alignment and support of the base upon installation and tear down of the system. A base through space 218 is incorporated in the flange to allow passage of the guide 10.

The rotational drive is provided by a disk 82 which is captured along its circumference by the flange 89 so that it provides bearing support in the rotational direction indicated, a bracket 84 which is integral with the disk, a rotational drive servomotor 88 which is attached to the bracket, and an external gear 90 which engages an internal gear that is integral with the flange. Rotational motion of the bracket (and hence the guide) is achieved by operating the servomotor 88. Encoder counts from the servomotor allow the rotational position of the bracket to be monitored. The servomotor moves with the bracket when it is operated. This configuration has been chosen because it allows for a compact construction of the base assembly, as the servomotor may be tucked close to the guide 10 without causing interference between the two.

A guide drive is provided for by a servomotor 22 which is attached to the bracket 84 and rotates a lead screw 104, which drives a nut 106. The servomotor has been located in front of the rotational drive servomotor in order to make the assembly compact. The nut 106 is constructed with a shoulders 107 and a hole 103 so that it may be mounted onto the back end of the guide in slot 108 (FIG. 6A) and attached with the use of a bolt 81 (FIG. 3) which passes through the hole to thread into the guide. The nut 106 chases up or down the lead screw when the servomotor is operated, thus causing the guide to be advanced in or out of the base assembly. The working length 85 of the lead screw is optimally equal to the pitch between adjacent ports 87 on the guide.

Alternate Embodiments/Configurations of the Invention

Referring now to FIG. 13 in which a second configuration invention is shown. The friction probe drive is mounted and attached to the back end of the guide so that it moves with the advance motions of the guide. The configuration is most suitable in cases when sufficient spaces exist around the access opening of the steam generator to allow for movement of the friction probe drive, in which case the port spacing may be optimized.

In this configuration, the friction probe drive and the back end of the guide have been modified to accept four fastening pins 97 to facilitate the attachment. A bearing adapter 92 has also been added to provide cantilever and rotational support to the guide while allowing it to be supported for linear motions through the base. The bearing adapter is suitably configured for mounting and attaching to the bracket 84 of the base 12. The lead screw 104 is constructed sufficiently long to allow the guide to be indexed over the required range.

Because the probe drive is attached to the guide, a fixed pathway is more readily established between the two, in which the method for obtaining continuous guidance to the friction probe means (FIG. 6) is unnecessary.

Also, because the probe drive assembly follows the motions of the guide, the maximum range 85 of the guide is determined by either the amount of space available around the access opening of the steam generator, or the maximum distance the friction probe drive can be cantilevered from the base before the configuration becomes unfeasible.

Referring now to FIG. 14 in which a third embodiment of the invention is shown. A gate 186 is used for directing the probe at the port locations instead of the shoe thus far described. Only the last two ports on the guide are shown. The preceding ports (not shown) are designed identical to the gate shown.

In this design, a gate 186 is used for directing the probe either along the internal channel 28 or along the partial arcuate channel 56. The gate is closed or opened by an actuator 192 which is pivotally attached to the gate and casings 23 of the guide. The last directing location (top half of FIG. 14) is optimally designed without a gate, as there are no more directing locations beyond it.

The gates may be operated separately or together. If they are operated separately, each will require a pneumatic line, and if they are operated together, then only one pneumatic line is necessary. This has the advantage of simplifying the design of the guide. However, the force with which the gates open must be small, and must comply to the presents of the probe body. The design, function, and operation of the remaining features of the gate is similar to the preferred embodiment.

The incorporation of a gate design in the guide may find application in situations where access inside and outside the steam generator access opening are relatively generous so that a slender guide design is not necessary.

Spool Drive for Probe

Figure 15:
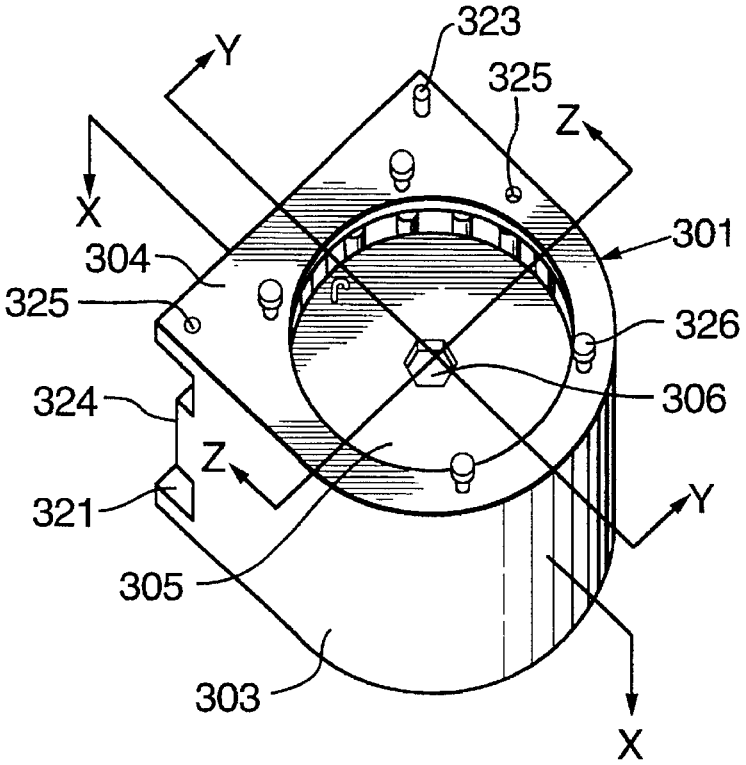
FIG. 15 is an isometric top view of the container of a preferred embodiment of the probe drive.

Referring to FIG. 15, an alternative and preferred probe drive will now be described. A container 301 has an arcuate side wall 303 and an upper surface 304, and defines a substantially cylindrical cavity 322 (best seen in FIG. 16). A spool cover 305 below the level of the upper surface 304 has a central aperture 306 which provides coupling for a drive means (not shown). The drive means can be secured and attached to the upper surface 304 by any suitable means, such as studs 326. The container can be secured and attached to the probe delivery system by any suitable means, such as pins 323 and holes 325 and mounted by any suitable means such as load-bearing plates 321 at the substantially rectangular rear wall 324 of the container or the upper surface 304 and the lower surface 302 (see FIG. 17) of the container at the arcuate side wall 303.

Figure 16:
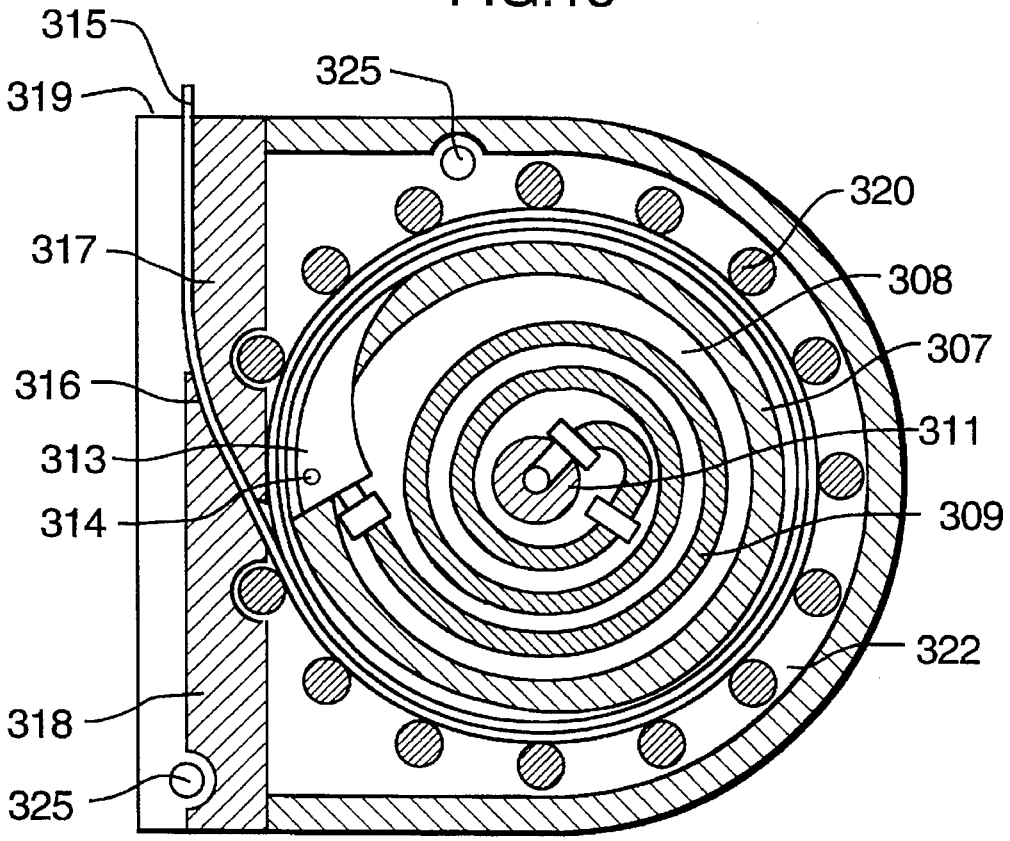
FIG. 16 is a sectional view of the embodiment of FIG. 15 along the lines X—X.

Referring to FIG. 16 a spool 307 is mounted within the container 301, so that it can rotate in a clockwise or counterclockwise direction. Within the inner cavity 308 defined by the spool, a coiled feed line 309 is connected to an input end 313 of the probe 315 and connected at a conduit 311. The conduit 311 is mounted to the container 301 and is configured for convenient connection with an input line 310 (see FIG. 17). The probe input end 313 passes through the spool 307 and is retained by any suitable retaining means such as a pin 314. The feed line 309 is coiled to accommodate the limited clockwise and counter-clockwise rotations of the spool 307, enabling the conduit 311 and the input line 310 to remain stationary with respect to the container 301. The input line 310, conduit 311 and feed line 309 provide a line connection means for connecting the input end 313 of the probe to a suitable function to enable the probe to be operated. The line connection means must be constructed accordingly to support the function. For example, if the probe was a high pressure water lance, the connection means would generally comprise high pressure hoses and fittings and a suitable function would comprise a high pressure water source. Alternatively, if the probe was a fiber optic device, the line connection means would generally comprise a sheath which provides strain relief for a delicate fiber optic cable and the suitable function would be a light source and camera. It is left up to the designer, who is familiar with the operating requirements of the probe to provide a line connection means of suitable construction to support the function.

The probe 315 is coiled to a predetermined length around the spool 307 in either the same or opposite rotational direction as the feed line 309 and is retained in position by any suitable means, such as the combined action of a series of vertical rollers 320 extending from the lower surface 302 to the upper surface 304 and surrounding the base of the spool 307 and the spool cover 305 without restricting movement of the probe in the appropriate directions. The output end of the probe passes through a deflection channel 316, defined by a supporting wedge 318 and a separating wedge 317, and exits through aperture 319 to the exterior of the container 301 to the probe delivery system and specifically to the probe guide. Deflection channel 316 may be designed with a generous bend radius to minimize bending stresses on the probe and the supporting wedge 318 and separating wedge 317 may be constructed from any suitable bearing material, such as a plastic for example.

Figure 17:
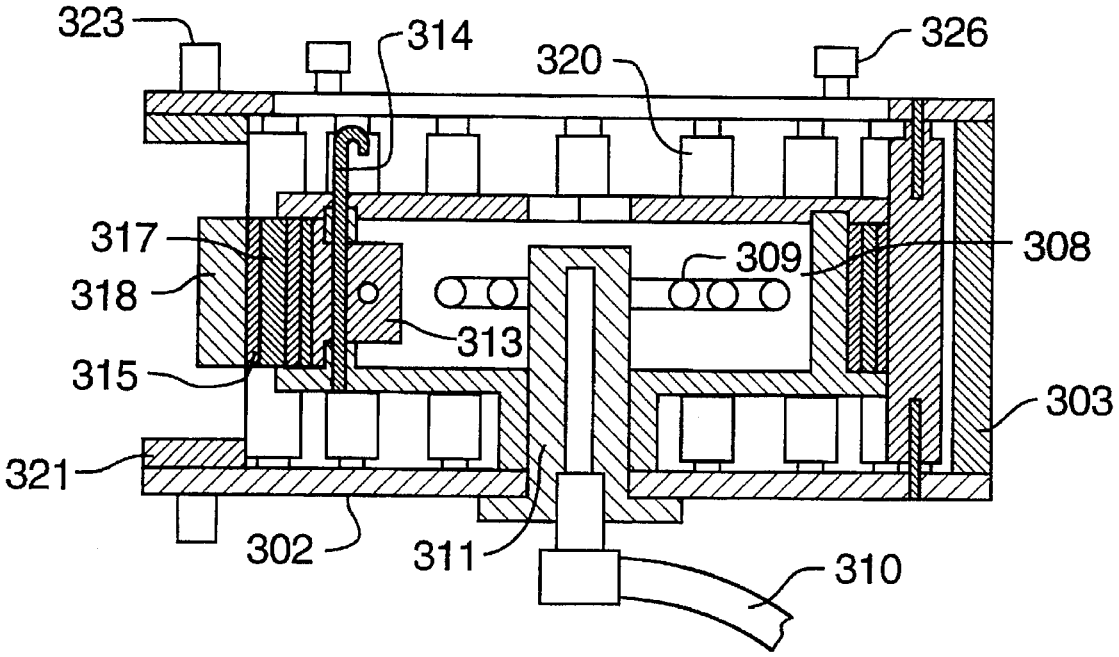
FIG. 17 is a sectional view of the embodiment of FIG. 15 along the lines Y—Y.
Figure 18:
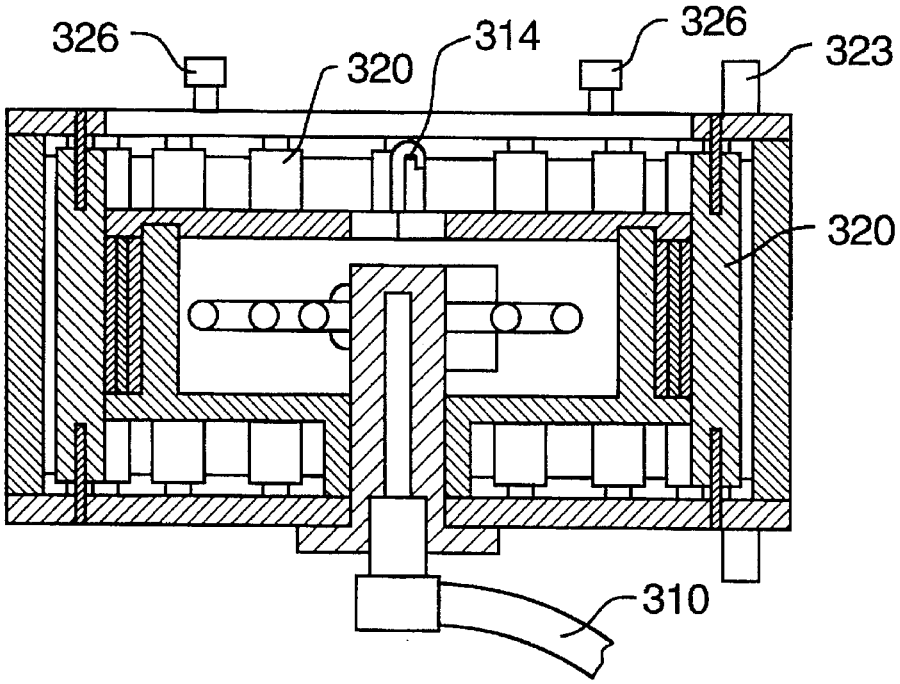
FIG. 18 is a sectional view of/he embodiment of FIG. 15 along the lines Z—Z.

Referring to FIGS. 17 and 18, the rollers 320 are mounted within the container 301 by attachment to the inside of the upper surface 304 and the inside of the lower surface 302 so that each roller can rotate freely about its vertical axis. The spacing between the centers of adjacent rollers is governed by the tendency of the probe 315 to buckle. The spacing must be small enough to prevent the probe 315 from buckling in an unstable manner between the rollers 320. This will depend on the stiffness of the probe 315 and the amount of compression force which will be exerted upon the probe 315 during operation. The diameter of the rollers 320 can be optimized for minimum rolling friction when they are made as large as possible without interfering with one another.

The size of the container 301 is governed primarily by the special criteria set by the probe 315. The height of the container 301 is determined primarily by the width of the probe 315 and the plan size of the container 301 is determined primarily by the minimum diameter to which the probe 315 may be coiled without causing harmful effects to it.

In operation, the input line 310, conduit 311, feed line 309, and input end 313 connect the probe 315 to its required function. The probe is driven into the probe delivery by selecting operation of the drive means on the spool 307 causing clockwise rotation of the spool 307 so that the probe 315 is unwound from the spool to the desired length, and the probe is retracted from the delivery system by causing a counterclockwise rotation of the spool 307 so that the probe is wound onto the spool 307. The rate at which the probe is driven in or out of the delivery system may be controlled by the drive means on the spool 307. During movement of the probe in and out of the delivery system the probe may be operated via the line connection means.

When the probe is driven into the delivery system less of the probe occupies the space between the rollers 320 and the spool 307 resulting in a gap at this location, and backlash will become apparent as the probe 315 is further extended into the delivery system. Because the amount of backlash is predictable, it may be compensated for by suitably configuring the drive means on the spool 307. In the ideal case the diameter of the spool 307 is made as large as possible so that the probe 315 is coiled as few times as possible decreasing the size of the gap left as the probe 315 is extended thus minimizing the effect of the backlash.

This configuration results in all the driving forces for the extension and retraction of the probe being imparted at the rear input 313 end of the probe and the probe body 315 is not used as an integral part of the drive mechanism. The probe body 315 thus experiences far less localized stress than arises from the use of sprockets or sprocket belts, and accordingly the probe body design is not restricted by criteria related to accommodation of such drive methods. The enclosed, compact structure of the container is particularly advantageous in view of the spatial limitations and obstructions normally encountered at the access locations for steam generators.

Design Considerations

The design of the guide depends largely upon the access condition immediately outside the access opening of the steam generator. Specifically, obstructions in the area, such as blow down pipes, instrumentation lines, or walls, dictate how flexible the guide design needs to be in order to provide clearance to facilitate its installation and removal from the no-tube lane.

For example, if at least one steam generator diameter of space is available outside the access opening, a rigid guide construction is feasible, and if half a steam generator diameter of space is available outside the access opening, a semi-rigid guide construction is feasible. The design of the guide thus far described (FIGS. 2 to 5) is feasible for obtaining a rigid or semi-rigid construction, depending largely upon the modules of elasticity of the material chosen for the casing 23. For example, a rigid construction may be obtained by using an aluminum or stainless steel construction, and a semi-rigid construction may be obtained by using a plastic material such as Delrin (trademark).

In a more extreme case, in which less than half a steam generator diameter is available (¼ say), a considerably more flexible design must be adapted into the design of the guide. This may be facilitated by adapting a hinged design in the guide design, much like the hinged design incorporated in wrist watch bands for making them flexible. Or alternatively, the guide could also be designed in segments which are assembled or disassembled to facilitate installation or removal of the guide. Neither the hinged or segmented designs are illustrated herein, because they are a natural evolution of the guide design, and a person who is skilled in the art of mechanical design could readily incorporate these changes into the design if necessary.

The port spacing 87 (FIG. 4) is largely dependent on the amount of space available outside the access opening of the steam generator. For example, if a considerable space is available, a large floor plan design may be used for the friction probe drive design which will allow for a large index range 85 (FIG. 6C) and hence a large spacing between the ports. This relation may be considered for optimizing the spacing between the ports.

Operation of the Apparatus

Figure 7:
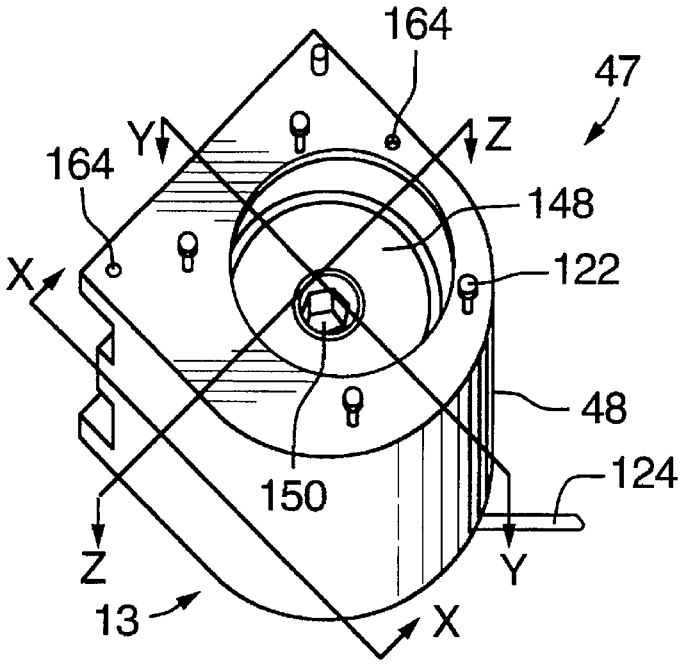
FIG. 7 is an isometric view of the container of a preferred embodiment of the friction probe drive.
Figure 10:
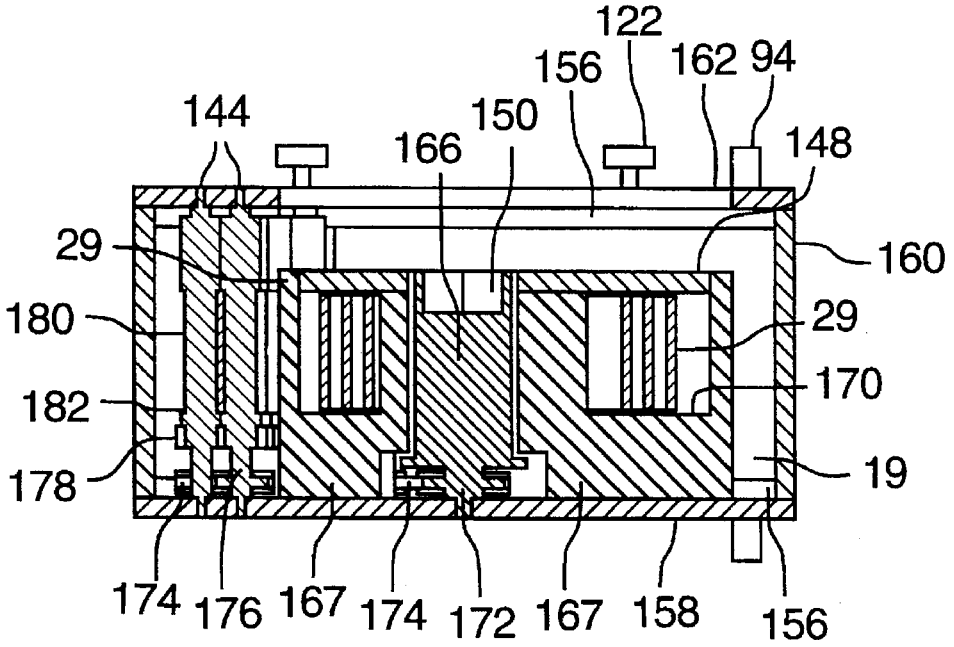
FIG. 10 is a sectional view of the embodiment of FIG. 7 along the lines Z—Z.

Referring again to FIG. 2, in which example is given where the probe is guided straight by the first and second shoes 30 (which are closed), and is directed by the third shoe 31 (which is open) into the tube bundle. The probe may be extended or retracted through this pathway by the friction probe drive 13, during which the probe may perform its operations via input line 124 (FIG. 7).

Access to any intertube lane along the no-tube lane can be achieved by coordinating the motions of the probe and guide, and the open and closed positions of the shoes. For example, the 11th intertube lane can be accessed by retracting the probe so that its tip clears the 3rd shoe, and the guide advanced along the no-tube lane so that the exit of the 3rd shoe is aligned with the 11th intertube lane.

Access to an intertube lane which is further removed from the above example is performed in a similar manner. For example, access to the 2nd intertube lane can be achieved by retracting the probe so that its tip clears the 1st shoe, placing all the shoes in the closed position, placing the 1st shoe in the open position, and advancing the guide along the no-tube lane so that the exit of the 1st shoe is aligned with the 2nd intertube lane.

In these examples, the first, second, and third ports are configured to access the first to fourth, fifth to eighth, and ninth to twelfth intertube lanes respectively. This relation may be carried on for all the ports on the guide, each port having its own specific range of intertube lanes it can access.

Hardware and Software Considerations

The motions performed by the delivery system are ideally driven by servomotors and actuating devices which are adapt for control by microcomputer. State of the art motion control technologies are ideal for this application. Such technologies include servomotors, and supporting hardware and software. It is from the software platform that the various motions of the invention are ideally coordinated to obtain optimal performance. Most specifically, the motions of the guide servomotor, rotational drive servomotor, probe drive servomotor, port actuators, and probe operating functions are coordinated and controlled by appropriate hardware and software.

In the ideal case, the control software relates a specific range of intertube lanes to a specific port, and calculates the advance position of the guide in order to achieve alignment of a port exit with a particular intertube lane. The control software also calculates where the tip of the probe is to position it to clear any one of the ports, and coordinate the port actuator(s) to close and open the appropriate ports(s). In this manner, the control software coordinates the motions of the system for accessing any particular intertube lane. This coordination may be further address by operation of the rotation drive servo motor for rotating the guide to achieve inclination of the probe within the tube bundle.

Establishing a Reference Position

A procedure for establishing a reference position for the guide drive axis's ideally performed upon set up of the system on a steam generator. In this procedure, the position of the guide along the no-tube lane is determined with respect the tube bundle. This information must be known in order to allow the geometry of the guide and tube bundle to be related so that alignment of corresponding port exits and intertube lanes can be achieved by calculations in software.

A reference position may be established by passing a probe into a known intertube lane. This may be done by passing a probe which has a visual capability (such as a fibre-optic) into the 1st intertube lane. The lane may be confirmed visually because it lies close the edge of the tube bundle.

Other methods may also be used for establishing the reference position, such as the use of cameras inside the no-tube lane which confirm the position of the guide, or by a proximity sensor 45 (FIG. 5) located at each port to align on a no-tube lane tube 58 (FIG. 2).

In these methods the reference position is ideally identified to the control software through manual input, in which case the relative position of the guide and tube bundle become initialized.

Conclusion

The object of the present invention is to provide an improved apparatus and method for delivering a probe into a steam generator tube bundle. The invention comprises a guide, a base, and a probe drive as described. Additional technologies have been included in the description to show how to make and use the invention. These technologies include the servomotor and the probe. It is left up to the lay person, who is skilled in the art of these technologies to relate them to the invention.

Most specifically, those skilled in the art of motion control technology can appropriately select, adapt and use the servomotors and computer control software as they relate to the invention, and those skilled in the art of waterlancing, inspection, sampling and retrieval technologies can appropriately adapt and use the probe as it relates to the invention. Also, those skilled in the art of drive and management technologies for the probe can appropriately incorporate and use a probe drive for use with the invention.

The present invention solves the problems associated with the prior art methods because it substantially reduces the range of motion required by the probe guide mechanism. The motion of the guiding mechanism has become a minor issue, which has a profound effect on the design of the rest of the system. This is because the reduced range of motion is in nature more apt for functioning in areas where motion is restricted. Special methods for accommodating large motions are unnecessary, resulting in a highly simplified method for advancing the probe guide mechanism. The invention optimizes the design of the probe guide mechanism for torsion stiffness, compactness, and reduces the number of sliding components. These improvements provide improved performance and cost savings.

We claim:

1. A probe delivery system for delivering a bendable probe into a tube bundle via an access opening through a shell surrounding the tube bundle, comprising an elongated guide insertable into said tube bundle via said access opening, said guide having channel means for directing said probe therealong and directing means spaced along the length of said guide, operable to selectively direct the probe either farther along said guide, or outwardly and away from said guide.

2. A probe delivery system as recited in claim 1, where said directing means comprises a plurality of pivotable port devices, said port devices each comprising a pivotable body with an arcuate channel therethrough, said pivotable body being mounted to said guide such that in one position said probe routes through said channel and is thereby diverted away from said guide, and in another position said probe bypasses said port device and is not diverted from extending farther along said guide.

3. A probe delivery system as recited in claim 2, further comprising first and second actuators, providing locking and pivoting actions to said pivotable body respectively.

4. A probe delivery system as recited in claim 1, where said directing means comprises a plurality of pivotable port devices, said port devices each comprising a pivotable gate mounted to said guide such that in one position said probe is routed farther along an internal channel in said guide, and in another position is routed along a partial arcuate channel and is thereby diverted away from said guide.

5. A probe delivery system as recited in claim 4, further comprising an actuator pivotally attached between each said gate and said guide to actuate said gate.

6. A probe delivery system as recited in claim 1, further comprising a base which is mountable on said shell, and a servomotor mounted on said base to move said guide into and retract said guide from said tube bundle.

7. A probe delivery system as recited in claim 6, further comprising a rotation drive servomotor mounted on said base for rotating the guide about its central axis.

8. A probe delivery system as recited in claim 1, further comprising a spool drive for said probe, said spool drive comprising:

a rotatable substantially circular spool around which said probe may be wound;

a boundary means concentric with, and spaced at a predetermined distance from, at least part of an outer circumference of said spool, said predetermined distance being sufficient to accommodate said probe when fully retracted and wound around said spool;

a line connection means for connecting an input end of said probe through said spool to a suitable function; and a deflection means for directing an output end of said probe into said guide.

9. A probe delivery system as claimed in claim 8, wherein said line connection means comprises a feed line contained within said spool, having an output end connected to said input end of said probe, and having an input end connected to said suitable function at a location outside said spool.

10. A probe delivery system as claimed in claim 8, wherein said boundary means comprises a plurality of spaced-apart rollers mounted outside the circumference of said spool.

11. A probe delivery system as claimed in claim 8, wherein said spool is rotatably mounted within a container, and wherein said deflection means is integral with said container and provides a fixed directional channel for said probe through said container.

* * * * *